US009140051B1

(12) United States Patent
Kierecki

(10) Patent No.: US 9,140,051 B1
(45) Date of Patent: Sep. 22, 2015

(54) WINDOW AND METHOD

(71) Applicant: STACPOL GENERAL CONSTRUCTION LTD., Calgary (CA)

(72) Inventor: Edmund Kierecki, Calgary (CA)

(73) Assignee: STACPOL GENERAL CONSTRUCTION LTD., Calgary (CA)

( * ) Notice: Subject to any disclaimer, the term of this patent is extended or adjusted under 35 U.S.C. 154(b) by 0 days.

(21) Appl. No.: 14/493,027

(22) Filed: Sep. 22, 2014

(51) Int. Cl.

| | |
|---|---|
| ***E04B 1/70*** | (2006.01) |
| ***E06B 3/263*** | (2006.01) |
| ***E06B 1/36*** | (2006.01) |
| ***E06B 1/60*** | (2006.01) |
| ***E06B 1/62*** | (2006.01) |
| ***E06B 3/04*** | (2006.01) |
| ***E06B 7/14*** | (2006.01) |

(52) U.S. Cl.
CPC . *E06B 3/263* (2013.01); *E06B 1/36* (2013.01); *E06B 1/6015* (2013.01); *E06B 1/6038* (2013.01); *E06B 1/62* (2013.01); *E06B 3/04* (2013.01); *E06B 7/14* (2013.01); *E06B 2001/628* (2013.01)

(58) Field of Classification Search
CPC ..... E06B 7/26; E06B 1/62; E06B 7/14; E06B 1/70; E06B 1/702; E06B 1/36; E06B 3/677; E04B 1/665; E04B 1/644; E04D 13/1415
USPC ..... 52/58, 60, 204.1, 204.5, 204.55, 52/204.62, 208–211, 213, 215, 302.1, 52/302.3, 302.6, 745.15, 656.1, 656.2, 52/656.4, 656.5, 656.6, 310, 97
See application file for complete search history.

(56) References Cited

U.S. PATENT DOCUMENTS

| | | | | |
|---|---|---|---|---|
| 4,821,472 | A * | 4/1989 | Tix | 52/204.55 |
| 5,119,609 | A * | 6/1992 | Tait et al. | 52/213 |
| 5,722,207 | A * | 3/1998 | Anderson et al. | 52/204.55 |
| 5,966,880 | A * | 10/1999 | Bridges et al. | 52/211 |
| 6,044,611 | A * | 4/2000 | Brunett | 52/656.5 |
| 6,389,763 | B1 * | 5/2002 | Clauss | 52/204.53 |
| 6,631,595 | B1 * | 10/2003 | Minter | 52/212 |
| 8,109,052 | B2 * | 2/2012 | Rosende et al. | 52/204.55 |
| RE43,457 | E * | 6/2012 | Anderson et al. | 52/215 |
| 8,584,410 | B2 * | 11/2013 | Furgerson et al. | 52/209 |
| 2002/0050103 | A1 * | 5/2002 | Ackerman, Jr. | 52/58 |
| 2003/0177725 | A1 * | 9/2003 | Gatherum | 52/302.1 |
| 2004/0154244 | A1 * | 8/2004 | Moffatt | 52/204.55 |
| 2004/0200160 | A1 * | 10/2004 | Derderian | 52/204.1 |
| 2006/0272238 | A1 * | 12/2006 | Honda | 52/211 |

(Continued)

FOREIGN PATENT DOCUMENTS

| | | |
|---|---|---|
| CA | 2652528 | 11/2009 |

*Primary Examiner* — Beth Stephan
(74) *Attorney, Agent, or Firm* — Bennett Jones LLP

(57) ABSTRACT

A window unit is provided, comprising: a frame body having an upper edge, a bottom edge and two side edges defining the perimeter of the frame; a pair of side mounting flanges, each comprising a substantially vertical plate and each secured along a respective side edge of the frame; an upper mounting flange comprising a substantially vertical plate and a ledge extending outwardly from a lower edge of the vertical plate; whereby the upper mounting flange is secured along the upper edge of the frame by means of the ledge such that the vertical plate of the upper mounting flange is in a first vertical plane behind a second vertical plane of the vertical plates of the side mounting flanges.

13 Claims, 3 Drawing Sheets

(56) References Cited

U.S. PATENT DOCUMENTS

| | | | | |
|---|---|---|---|---|
| 2007/0125013 | A1* | 6/2007 | Prince | 52/204.1 |
| 2008/0110110 | A1* | 5/2008 | Burton et al. | 52/213 |
| 2008/0271394 | A1* | 11/2008 | Hand et al. | 52/210 |
| 2009/0266014 | A1* | 10/2009 | Green | 52/204.55 |
| 2010/0242385 | A1* | 9/2010 | Cashman | 52/213 |
| 2011/0083382 | A1* | 4/2011 | Sanders | 52/215 |
| 2011/0154753 | A1* | 6/2011 | Furgerson et al. | 52/204.1 |
| 2011/0258962 | A1* | 10/2011 | Peterson | 52/656.5 |
| 2013/0133276 | A1* | 5/2013 | Furgerson et al. | 52/204.1 |

* cited by examiner

WINDOW AND METHOD

FIELD OF INVENTION

This invention relates generally to a window and a method of installing a window.

BACKGROUND OF THE INVENTION

A conventional window frame has an upper flange, a lower flange, and two side flanges that are generally fastened directly on to plywood sheathing of a wall of a building during installation. Insulation sheets are usually disposed directly on the outer surface of the upper flange and plywood is used to cover the outer surface of the insulation sheets. Traditionally, a lower (river) flashing is disposed adjacent the lower edge of the window frame, on the outer surface of the lower flange. An upper flashing is generally fastened to the plywood sheathing of the wall through the upper flange.

Buildings, including their windows, are exposed to water under various weather conditions. The water that buildings are exposed to includes for example rain water and water from condensation, melted ice, snow, and frost. With the conventional window and method of window installation, water can seep behind the upper flange and will trickle down between the flashing/upper flange and the plywood at the top of the window, which can cause the plywood to deteriorate. Further water can seep behind the lower flashing through the lower flange, into the plywood sheathing, which can also cause the plywood to deteriorate.

Further, the placement of the insulation sheets can prevent water from flowing down the flange, causing water to seep into the plywood behind the flange and the plywood covering the insulation sheets. Water from the plywood sheathing can also seep into 25 other parts of the wall, such as studs and insulation materials. Water damage to the wood components of the wall can compromise the strength and integrity of the wall. Further, mold can easily develop in damp areas inside the wall, which can pose a serious health threat.

SUMMARY OF INVENTION

The present invention provides a window and a method of installing a window.

In one aspect, a window unit is provided, comprising:

a frame body having an upper edge, a bottom edge and two side edges defining the perimeter of the frame;

a pair of side mounting flanges, each comprising a substantially vertical plate and each secured along a respective side edge of the frame;

an upper mounting flange comprising a substantially vertical plate and a ledge extending outwardly from a lower edge of the vertical plate;

whereby the upper mounting flange is secured along the upper edge of the frame by means of the ledge such that the vertical plate of the upper mounting flange is in a first vertical plane behind a second vertical plane of the vertical plates of the side mounting flanges.

In another aspect, a method is provided for installing a window of the present invention, comprising:

attaching the frame body of the window to a first material by means of the upper mounting flange such that the ledge of the upper mounting flange rests on a top edge of a second material;

attaching each side flange to the second material;

whereby the first material is recessed from the second material by a distance about the same as the width of the ledge of the upper mounting flange.

BRIEF DESCRIPTION OF THE DRAWINGS

Drawings are included for the purpose of illustrating certain aspects of the invention. Such drawings and the description thereof are intended to facilitate understanding and should not be considered limiting of the invention. Drawings are included, in which.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

In the description, "up," "upward," "above" and "upper" denote a position that is further away from the ground than "down," "downward," "below" and "lower"; "front," "outward" and "outer" denote a position that is further away from the interior space of a wall and/or building than "behind" and "inner".

Figure 1:
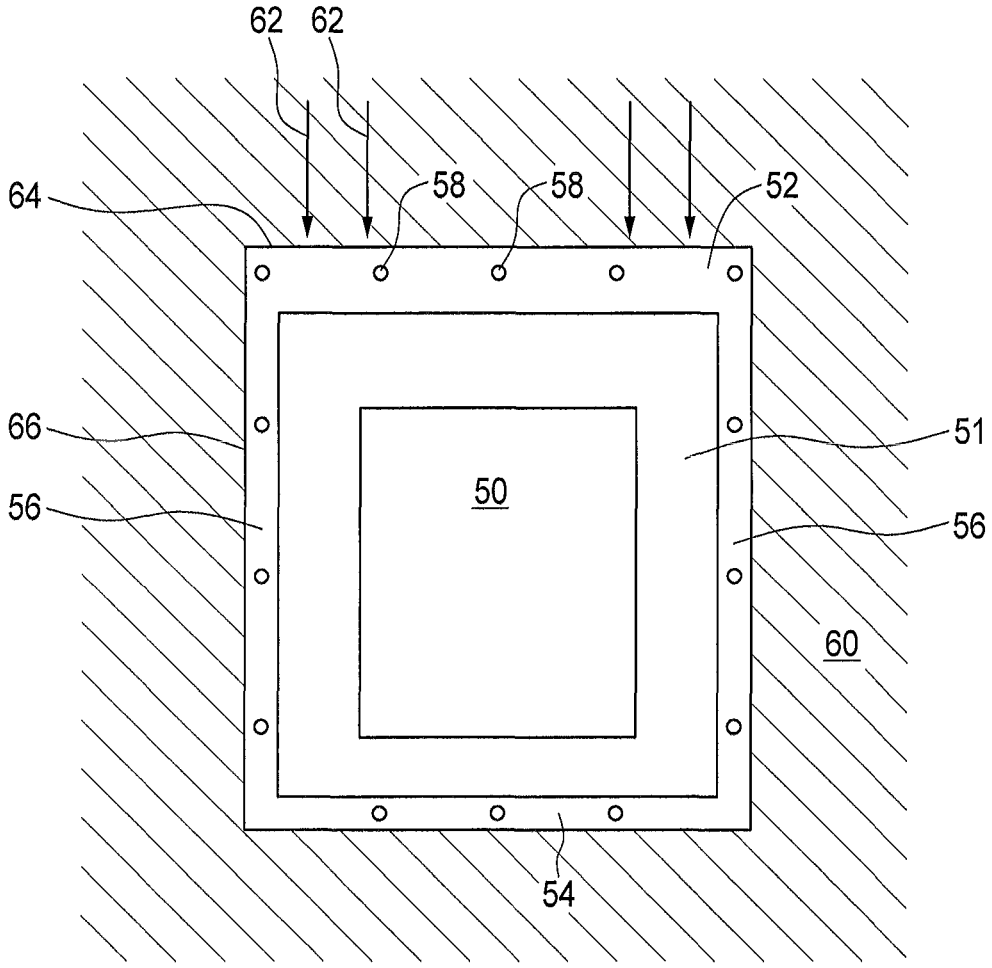
FIG. 1 (PRIOR ART)
FIG. 1 is a planar view of a conventional prior art window.

FIG. 1 shows a conventional window 50 (prior art). Window 50 comprises a frame 51 and extending from or attached to the frame 51 are an upper mounting flange 52, a lower mounting flange 54 and two side mounting flanges 56. Each flange is provided with a plurality of holes 58 through which a nail, screw, etc. can be used to fasten the window 50 directly to the plywood 60. Additionally, upper flashing (not shown) can be attached to upper flange 52 and lower flashing (not shown), also referred to as river flashing, can be attached to lower flange 54 for directing water away from the window. Nevertheless, it was discovered that any water/moisture which trickles down the plywood 60 (shown as arrows 62) will still be able to find its way into space 64 formed between upper flange 52 and plywood 60. Furthermore, any moisture which may pour off the sides of the upper flashing (not shown) may also be able to seep into space 66 formed between side flanges 56 and plywood 60.

Figure 2:
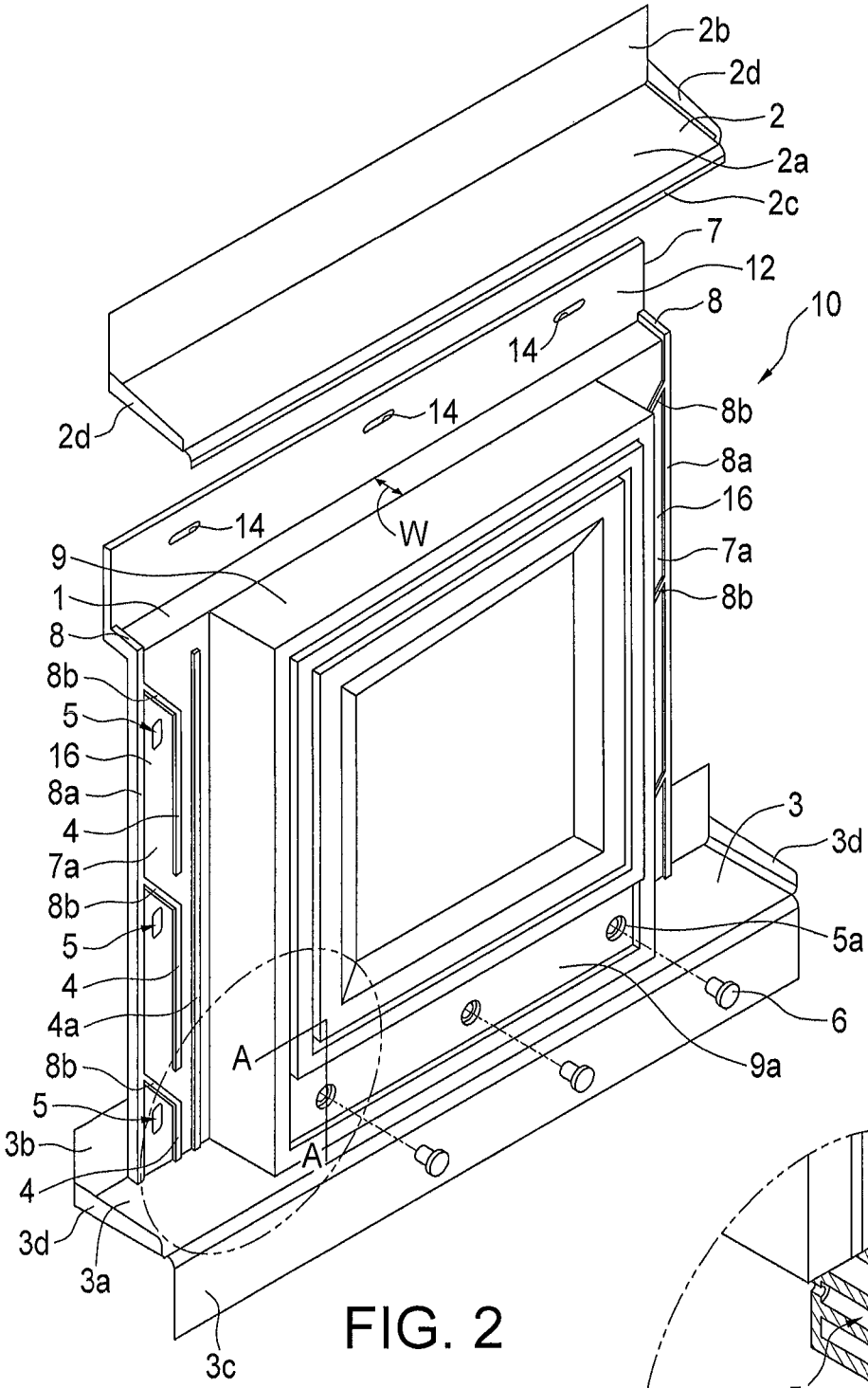
FIG. 2 is a perspective and partially exploded view of an embodiment of a window of the present invention.
Figure 3:
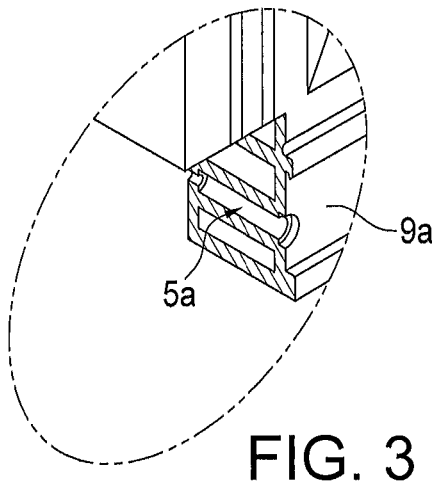
FIG. 3 is a magnified cross-sectional view of the window of FIG. 2, along the line of A-A.

The present invention attempts to address one or all of the moisture related problems associated with prior art windows. Referring to FIGS. 2 and 3, a window 10 of the present invention has a frame 9 and extending from or attached to the frame 9 are an upper mounting flange 7 and two side mounting flanges 7*a*. In this particular embodiment, the lower portion of frame 9, referred to as lower frame 9*a*, has been adapted to fasten directly to a surface, eliminating the need for a lower mounting flange. There are advantages in not having a lower flange, which will be discussed in more detail below.

It is understood, however, that a lower mounting flange can be used while still enjoying many of the benefits of the present invention.

Some or all of upper flange 7, side flanges 7*a*, and frame 9 may be formed as a single part from one piece of material or may be formed separately as individual components and subsequently joined together. The separate components may be joined together in various ways including for example welding, adhesives, fasteners, etc. Window 10 is preferably made of materials that are suitable for indoor and outdoor use and can withstand ordinary temperature differentials between indoor and outdoor spaces and between seasons. Window 10 may be made of various materials including for example aluminum, vinyl, composite, fiberglass, and wood, or a combination thereof. The components of window 10 may be made by extrusion, machining, and the like.

Figure 4:
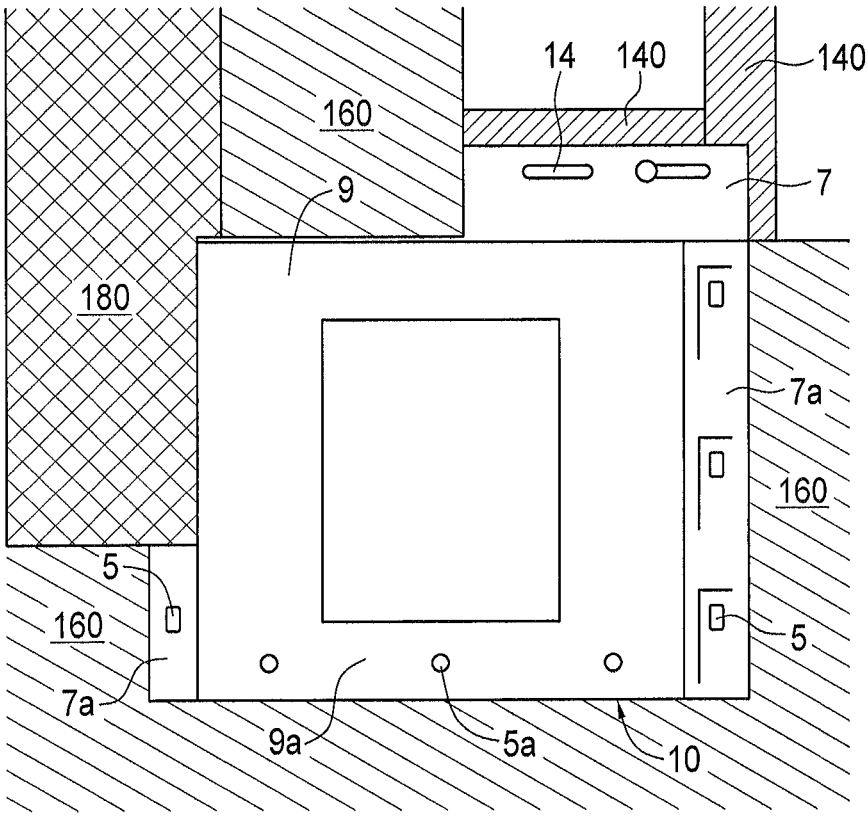
FIG. 4 is a planar view of an embodiment of a window of the present invention where portions of the finished installed window are broken away to show installation of the window.

Upper flange 7 provides an area for connecting the window to the sheathing and/or studs of the wall, which is shown in FIG. 4 and will be discussed in more detail below. In one embodiment, upper flange 7 includes a substantially vertical plate 12 and apertures 14 therein for receiving fasteners or the like therethrough. Upper flange 7 may assist in preventing water from its outer surface from seeping in to a surface on to which upper flange is to be mounted. Upper flange 7 further comprises an outwardly extending ledge 1, which extends outwardly from the plane of the vertical plate 12 of flange 7. The ledge 1 is preferably connected to the bottom of vertical plate 12 and is also connected to the upper ends of side flanges 7*a* and frame 9*a*. Thus, the upper ends of side flanges 7*a* and the upper edge of frame 9 are connected to the upper flange 7 via ledge 1. Width W denotes the perpendicular distance by which ledge 1 extends from the outer surface of upper flange 7.

The magnitude of W is approximately the same as the thickness of a wall sheathing (e.g., plywood) on to which side flanges 7*a* are to be mounted. The presence of ledge 1 offsets upper flange 7 and side flanges 7*a* by a distance W such that upper flange is in a first vertical plane behind a second vertical plane in which the side flanges are positioned. It is not necessary that the upper surface of ledge 1 be perpendicular to the outer surface of upper flange 7. In one embodiment, ledge 1 is sloped downwardly towards the outer surface of window 10. The sloping in ledge 1 may direct any water flowing down from above to flow down side flanges 7*a*.

Ledge 1 may include a ridge 8 at or near the edge on each end. A "ridge" used herein refers to a raised portion relative to a substantially planar surface, which may function to block and/or redirect the flow of water. One end of ridges 8 may be connected to the outer surface near the lower edge of upper flange 7. The other end of ridges 8 extend towards the upper ends of side flanges 7*a*. Ridges 8 may prevent water from flowing out the ends of ledge 1 and may direct any water on ledge 1 to flow down side flanges 7*a*.

Each of the side flanges 7*a* provides an area for attaching the window to a wall sheathing (e.g., plywood) and comprises a substantially vertical plate 16. In one embodiment, each side flange 7*a* includes apertures 5 for receiving fasteners such as nails, screws, bolts or the like therethrough located on the vertical plate 16. Side flanges 7*a* may direct water to flow downwards on their outer surface and may prevent water from 25 their outer surface from seeping into a surface on which the side flanges are to be supported. Side flanges 7*a* each extend laterally away from frame 9, along the length of either side of frame 9. Each side flange 7*a* is connected on a first side along its length to frame 9. In one embodiment, a second side of each side flange 7*a* (which is not connected to frame 9) includes a ridge 8*a* along the length thereof. Ridge 8*a* 30 assists in preventing water from flowing out past the second side of side flange 7*a*.

Ridge 8*a* may be at or near the edge of the second side of each side flange 7*a*. In a further embodiment, the upper end of ridge 8*a* connects to one end of ridge 8. Ridge 8*a* may run substantially continuously along the length of the second side of each side flange 7*a*. In another embodiment, ridge 8*a* may comprise of a plurality of spaced-apart ridge segments.

In one embodiment, each side flange 7*a* further includes at least one ridge 8*b* on the front face of vertical plate 16. Ridge 8*b* is positioned just above aperture 5 to help any water flowing down the outer surface of side flanges 7*a* to circumnavigate the aperture 5, thereby preventing water from flowing into the aperture 5 and seeping into the area behind side flanges 7*a*. In another embodiment, the upper end of ridge 8*b* connects to ridge 8*a* to form a shield above aperture 5. In a further embodiment, side flanges 7*a* each include at least one ridge 4, an upper end of which may connect to a lower end of ridge 8*b*. Ridge 4 helps to guide any water on the outer surface of side flanges 7*a*, especially any water bypassing aperture 5 via ridge 8*b*, to flow downwards. Each of side flanges 7*a* may further include a ridge 4*a*, which may be positioned lengthwise on the outer surface of flanges 7*a* near the first side. Ridge 4*a* helps to direct water on the outer surface of flange 7*a* to flow downwards. Ridge 4*a* may run substantially continuously along the length of the first side of each side flange 7*a*. In another embodiment, ridge 4*a* may comprise of a plurality of spaced-apart ridge segments.

Ridges 8*a*, 8*b*, 4 and 4*a* form raised channels for directing the water down the outer surface of the vertical plates 16 of the side flanges 7*a*. It is understood that other methods for forming raised channels can be used.

Any of ridges 8*a*, 8*b*, 4 and 4*a* may further assist in preventing any materials covering side flanges 7*a* from being in direct contact with the outer surface of side flanges 7*a*, thereby maintaining a clear flow path and preventing any potential blockage of water flow down the outer surface of the side flanges.

In one embodiment, some or all of the above-mentioned ridges may be replaced with grooves, which are recessed portions relative to a substantially planar surface that may function to redirect the flow of water. The ridges and grooves may have various shapes, including example substantially linear, curved, wavy, etc.

Frame 9 is connected at the upper end to upper flange 7 and, in some embodiments, to ledge 1. Frame 9 may have an outer surface that is substantially flush with that of side flanges 7*a*. In another embodiment, frame 9 may protrude outwardly from ledge 1 and the vertical plane of side flanges 7*a*. In yet another embodiment, the outer surface of side flanges 7*a* is substantially perpendicular to the side edges of frame 9. Frame 9 may include, preferably at its center, at least one layer of substantially transparent material, such as for example glass, plastic, etc., to allow light to travel between an exterior space and an interior space.

Lower frame 9*a* provides an area for connecting the window to a wall sheathing (e.g., plywood). In one embodiment, lower frame 9*a* includes apertures 5*a* for receiving fasteners or the like therethrough. As previously mentioned, however, a lower mounting flange could be added for securing the bottom of the frame to wall sheathing.

An upper flashing 2 and a lower (river) flashing 3 may be placed above and below window 10, respectively, during installation. Flashings 2 and 3 are each a strip of metal or other impervious material installed with the window to help prevent the passage of water into the wall at the joints. Flashings 2 and 3 may be similarly shaped, each having a substantially planar middle section (2*a* and 3*a*, respectively) with a back extension (2*b* and 3*b*, respectively) extending substantially vertically upwardly on one side and a front extension (2*c* and 3*c*, respectively) extending substantially vertically downwardly on the other side. The back and front extensions extend substantially along the entire length of either side of the planar middle section. The planar middle sections 2*a* and 3*a* may further include end extensions (2*d* and 3*d*, respectively) that extend substantially vertically upwardly at both ends of the section. The planar middle section may be sloped downwardly from the back extension to the front extension, such that when the back extension is substantially vertical, any water on the planar middle section tends to flow towards and down the front extension.

Window 10 may be installed in a wall in various ways. The method described below with reference to FIGS. 2, 3 and 4 is one example of how window 10 may be installed. A hole is provided in the wall where window 10 is to be installed. The hole is sized and shaped to accommodate the window and may be of various shapes depending on the shape of the window to be installed. In one embodiment, the hole is rectangular in shape and is framed by wall components such as studs and sheathing. In a further embodiment, an upper stud, which may be substantially horizontal, frames the upper edge of the hole. Framing the side edges and the lower edge of the hole is wall sheathing, e.g., plywood, which is supported on studs.

FIG. 4 shows window 10 and the various steps of installation. The upper flange 7 of window 10 is fastened to upper stud 140, which upper stud 140 is positioned over the top portion of window opening or hole. Upper flange 7 is fastened/attached to upper stud 140 by fastening devices being inserted into apertures 14 and forced through upper stud 140. Side flanges 7*a* are fastened to plywood 160, which plywood 160 surrounds the other three sides of the window opening or hole. Side flanges 7 are fastened/attached to plywood 160 by fastening devices being inserted into apertures 5 and forced through plywood 160.

As shown in FIG. 2, window 10 may have lower (river) flashing 3 placed at a lower portion of window 10. In this instance, back extension 3*b* of lower flashing 3 is placed between plywood 160 and the lower frame 9*a* of window 10 such that the back extension 3*b* of flashing 3 is disposed between the inner surface of the lower portion 9*a* of window 10 and the outer surface of the sheathing (e.g., plywood) framing the lower edge of the hole ("lower sheathing"). The upper surface of the planar middle section 3*a* of flashing 3 is adjacent to the lower ends of side flanges 7*a* and the lower edge of lower frame 9*a*. Window 10 is aligned with the hole such that upper flange 7 is substantially flush with the outer surface of the upper stud, and that the ends of ledge 1 cover a portion of the upper edge of the sheathing (e.g., plywood) framing the sides of the hole ("side sheathing"). The magnitude of width W of ledge 1 is preferably sufficient to accommodate the thickness of the side sheathing, such that side flanges 7*a* are substantially flush with the outer surface of the side sheathing. However, the side sheathing may be trimmed and/or cut to fit behind side flanges 7*a* such that when upper flange 7 is substantially flush with the outer surface of the upper stud, side flanges 7*a* are also substantially flush with the outer surface of the side sheathing.

Window 10 may be secured to the frame of the hole in various ways, including for example by fasteners, adhesives, or a combination thereof. Fasteners include for example screws, nuts and bolts, nails, staples, rivets, snap fittings, etc. Adhesives include hot adhesives, cold adhesives, chemical reaction bonding, etc.

In one embodiment, lower frame 9*a* is secured to the lower sheathing, with the back extension 3*b* of lower flashing 3 wedged therebetween, by fasteners through apertures 5*a* and the back extension. As can be seen in FIG. 2, placement of the lower flashing 3 such that the planar middle section 3*a* is adjacent to the lower ends of side flanges 7*a* allows any water that may fall from ledge 1 to be directed by the ridges of the side flanges 7*a* and fall directly on the planar middle section 3*a*. Further, if any water accumulates on planar middle section 3*a*, the water will not be able to damage the wall behind as a result of back extension 3*b*.

In a further embodiment, side flanges 7*a* is secured to the side sheathing by fasteners through apertures 5. In a still further embodiment, upper flange 7 is secured to the upper stud by fasteners through apertures 14. In another embodiment, any of the apertures 5*a*, 5, and 14 may be covered with a plug 6, whether the aperture has received a fastener. Plug 6 may be secured to the aperture in various ways including for example adhesives, friction fitting, threaded connections, snap fitting, etc.

After upper flange 7 is secured to the upper stud, flashing 2 may be supported thereon to substantially cover upper flange 7 and ledge 1. Flashing 2 is disposed such that its back extension 2*b* is adjacent to the outer surface of upper flange 7 and its planar middle section 2*a* is adjacent to the upper surface of ledge 1. Flashing 2 may be secured to upper flange 7 by fasteners and/or adhesives.

As shown in FIG. 4, wall sheathing, in this case, plywood 160, can then be placed over the outer surface of flange 7, or if flashing 2 is used, plywood 160 can be placed over the outer surface of the back extension 2*b* of flashing 2, and the wall sheathing may be secured to window 10, the upper stud, and/or other components of the wall. In one embodiment, insulation sheets 180 are disposed on the wall sheathing to substantially cover the outer surface thereof. In a further embodiment, insulation sheets 180 are placed over side flanges 7*a* to substantially cover the outer surface thereof. Outer wall material (such as for example stucco, vinyl, stone, Smartboard™, etc.) may be disposed on the outer surface of the insulation sheets.

The above-described window and method of installation thereof may help prevent water leakage into wall components. For example, water flowing down the wall sheathing (plywood) from above the window or from the outer wall would first encounter the planar middle section 2*a* of flashing 2 and then flow off the front extension 2*a* of flashing 2. If flashing is not used, water would still flow away from the wall due to flange 7 and ledge 1. Any water that finds its way onto ledge 1 would be directed away via ridges 8*a*, 8*b*, 4 and 4*a* on side flanges 7*a*.

Any water on the outer surface of frame 9 would flow downwards on to the planar middle section 3*a* of flashing 3 and then past the front extension 3*a* of flashing 3. Any water that may have accumulated on the outer surface of upper flange 7 would flow down on to ledge 1 and then down side flanges 7*a* on to the planar middle section 3*a* of flashing 3. Flashing 3 would then direct the water to flow off the front extension 3*c* thereof. Similarly, any water that may have accumulated on side flanges 7*a* or the side edges of frame 9 would flow downwards on to flashing 3 and then past the front extension thereof. The window and installation thereof disclosed herein assist in minimizing water exposure and accumulation at the joints between the window and the wall components.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. For US patent properties, it is noted that no claim element is to be construed under the provisions of 35 USC 112, sixth paragraph, unless the element is expressly recited using the phrase "means for" or "step for".

I claim:

1. A window unit, comprising:

a frame body having an upper edge, a bottom edge and two side edges defining the perimeter of the frame body;

a pair of side mounting flanges, each comprising a substantially vertical plate and each secured to one of the side edges;

an upper mounting flange comprising a substantially vertical plate and a ledge extending outwardly from a lower edge of the vertical plate;

whereby the upper mounting flange is secured along the upper edge by means of the ledge such that the vertical plate of the upper mounting flange is in a first vertical plane that is rearwardly offset from a second vertical plane of the vertical plates of the side mounting flanges.

2. The window unit as claimed in claim 1, further comprising a plurality of raised channels on a front face of the vertical plates of the side mounting flanges.

3. The window unit as claimed in claim 1, further comprising at least one flashing.

4. The window unit as claimed in claim 3, wherein the at least one flashing is an upper flashing comprising a substantially planar middle section and a back extension extending substantially vertically upwardly and attached to a back edge of the planar middle section.

5. The window unit as claimed in claim 4, wherein the upper flashing is attached to the vertical plate of the upper mounting flange by means of the back extension.

6. The window unit as claimed in claim 4, wherein the upper flashing further comprises a front extension extending substantially vertically downwardly from a front edge of the planar middle section.

7. The window unit as claimed in claim 4, wherein the planar middle section is sloped downwardly.

8. The window unit as claimed in claim 3, wherein the at least one flashing is a lower flashing comprising a substantially planar middle section and a back extension extending substantially vertically upwardly and attached to a back edge of the planar middle section.

9. The window unit as claimed in claim 8, wherein the lower flashing further comprises a front extension extending substantially vertically downwardly from a front edge of the planar middle section.

10. The window unit as claimed in claim 8, wherein a lower portion of the frame body is adapted to be mounted to a surface.

11. The window unit as claimed in claim 10, wherein the back extension of the lower flashing is positioned behind the lower portion of the frame body such that the front extension of the bottom flange extends past a front face of the frame body.

12. A method for installing a window unit as claimed in claim 1, comprising:

attaching the frame body to an outer surface of a first material by means of the upper mounting flange such that the ledge of the upper mounting flange rests on a top edge of a second material;

attaching each side flange to an outer surface of the second material;

whereby the outer surface of the first material is recessed from the outer surface of the second material by a distance about the same as a width of the ledge of the upper mounting flange.

13. The method as claimed in claim 12, further comprising covering the upper mounting flange with a material similar or the same as the second material such that an outer surface of the material will be substantially flush with the outer surface of the second material.

* * * * *